United States Patent [19]

Zehr

[11] Patent Number: 4,997,135

[45] Date of Patent: Mar. 5, 1991

[54] GRINDING APPARATUS

[76] Inventor: Melvin A. Zehr, Box 266, Middleton, Id. 83644

[21] Appl. No.: 471,402

[22] Filed: Jan. 29, 1990

[51] Int. Cl.[5] ..... B02C 13/286

[52] U.S. Cl. ..... 241/101.7; 241/186.4

[58] Field of Search ..... 241/186.4, 101.7, 189 R, 241/189 A, 285 R, 285 A, 285 B

[56] References Cited

U.S. PATENT DOCUMENTS

| | | | |
|---|---|---|---|
| 3,966,128 | 6/1976 | Anderson et al. | 241/101.7 X |
| 4,364,526 | 12/1982 | White | 241/101.7 X |
| 4,383,651 | 5/1983 | Couperus | 241/101.7 X |
| 4,448,361 | 5/1984 | Marcy | 241/101.7 |

*Primary Examiner*—Mark Rosenbaum

*Attorney, Agent, or Firm*—Paul F. Horton

[57] ABSTRACT

Grinding apparatus of the pivotal tub type with means for conveying ground material, said apparatus including a wheel mounted chassis; a tub, mounted on the chassis for receiving material to be ground, said tub provided with a rotatable side wall and a non-rotatable floor, and said tub being pivotal in a direction transverse to the direction of normal movement of the chassis; a grinder extending upwardly through an aperture in the floor to engage material within the tub; a bin for receiving ground material; and a conveyor system extendible rearwardly from the normal direction of movement of the chassis and foldable over the tub for compactness during transportation from site to site. The side pivoting tub, in combination with the extendible and foldable conveyor make the apparatus practical for movement on the highways. A deflector, mounted on the floor of the tub, lessens recirculation of ground material and prevents potentially dangerous material from flying from the tub in its engagement with the grinder.

13 Claims, 3 Drawing Sheets

CCW
CW

GRINDING APPARATUS

BACKGROUND OF THE INVENTION

1. Field of the Invention

This invention relates generally to grinders and hammermills, and, more particularly to mobile wood choppers and refuse grinders of the pivot tub type, having means for conveying ground material to trucks for hauling.

2. Description of the Prior Art

It is highly desirable to transport a grinder or hammermill to the area the material to be ground or pulverized is located. Such transportation requires that the apparatus conform to the rules of the road, particularly in reference to width. It is also desirable that the equipment be readily accessible for maintenance and repair and that the material worked upon be conveniently loaded for distribution.

Mobile units of the pivotal tub type are known for feed and hay chopping as typified by U.S. Pat. No. 4,448,361, issued to D. Marcy and U.S. Pat. No. 4,846,411, issued to M. M. Herron, et al. Such units have a tub which is pivotal rearwardly, i.e. to the normal direction of movement so that the tub may be tilted horizontally and backed into the hay or feed for loading and then pivoted to a position about a vertical axis for chopping. Such construction requires any discharge structure for the chopped hay or feed to be side oriented, i.e. extend transverse to the normal direction of movement, and therefore such structure cannot be made suitable for road travel. In that both Marcy and Herron disclose hay choppers, only blower type dischargers are provided. U.S. Pat. No. 4,364,526, issued to A. A. White, discloses a tub type feed chopper having a tub set at a specified angle relative to the chassis. White utilizes an auger type conveyor for discharge of the disintegrated material. The White device is also unsuited for road travel in the use of the tilted tub in combination with tub loading equipment and laterally swinging conveyor.

Use of shields to prevent injury from flying debris and to prevent recirculation of ground material has not been known to be used on pivoting tub type grinders; but then such choppers have been largely limited to feed material and are not used for grinding wood, refuse, and the like.

SUMMARY OF THE INVENTION

The present invention comprises, generally, grinding and pulverizing apparatus having a mobile chassis; a tub, with a cylindrical, rotatable sidewall and non-rotatable floor, which is pivotal transverse to the normal direction of movement of the chassis for the emptying of coarse or ungrindable materials; a hammermill which extends upwardly through the floor of the tub to engage material contained within the tub; and a conveyor which is rearwardly extending and foldable to a position over the tub for convenient storage during transportation of the unit. A shield, attached to the floor so as to be pivot therewith, conducts ground material into any underlying bin, thereby preventing recirculation of the material, and also prevents debris which has engaged the hammermill from flying out of the tub.

It is therefore a primary object of the present invention to provide grinding apparatus which is provided with a tub pivotal in a direction transverse to the normal direction of travel of the unit for convenient emptying of coarse material remaining in the tub and for cooperation with a belt conveyor in storage of the conveyor over the tub for transportation from site to site.

It is also an important object of the present invention to provide grinding apparatus with a rearwardly extending belt conveyor for discharge of ground material from the apparatus while minimizing width of the apparatus.

More specifically, it is an object of the present invention to provide grinding apparatus having a belt conveyor which is foldable to a storage position over the tub during transportation and which is unfolded for conveying operation.

Another object of the present invention is to provide grinding apparatus which includes pivotal tub type grinding apparatus which includes a floor mounted shield operable to prevent recirculation of ground material and which prevents material from flying from the tub upon impact with the hammermill.

Additional objects and advantages will become apparent and a more thorough and comprehensive understanding may be had from the following description taken in conjunction with the accompanying drawings forming a part of this specification.

DETAILED DESCRIPTION OF THE INVENTION

Figures 1, 2:
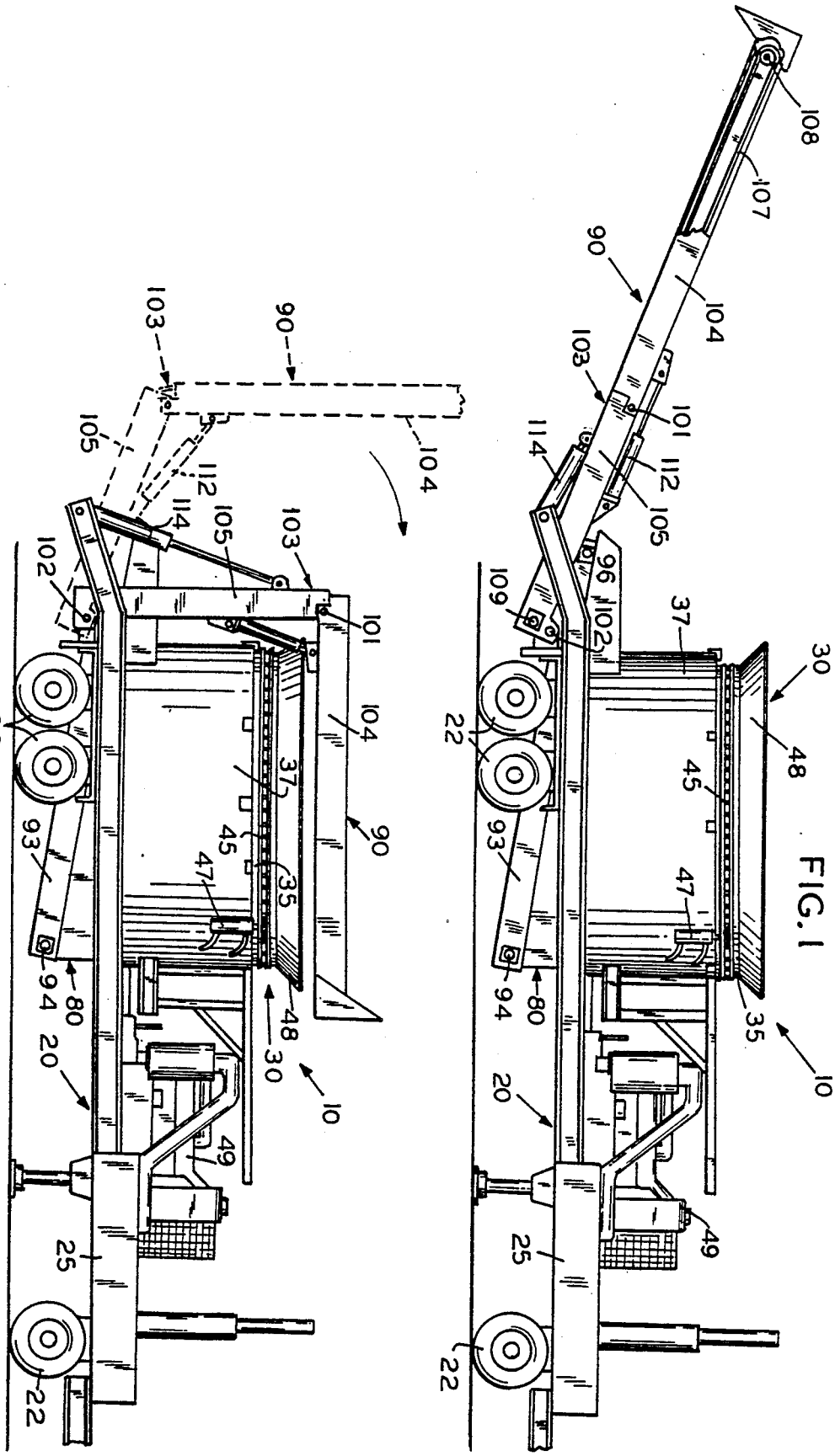
FIG. 1 is a side elevation of grinding apparatus made according to the present invention, showing the tub in the grinding position and the conveyor in an extended operation position.
FIG. 2 is a side elevation of the apparatus of FIG. 1, showing the conveyor, in broken lines, in a partially folded position, and showing the conveyor folded over the tub in a storage mode for transportation of the unit from site to site.

Referring now to the drawings, and FIGS. 1–4, in particular, an embodiment to be preferred of grinding apparatus 10, made according to the present invention, is disclosed. Grinding apparatus 10 includes, generally, a mobile chassis 20; a material containment tub 30; means for pivoting the tub, designated generally by the numeral 50; grinding means, designated generally by the numeral 70; a bin 80 for receiving ground material; and conveyor means, designated generally by the numeral 90.

Chassis 20 includes a frame 25 mounted on wheels 22 for towing. The normal direction of movement of the apparatus is in a straight forward or rearward direction, as shown by the wheel alignment, and in alignment with the plane of the page.

Carried by frame 25 is cylindrical tub 30. The tub may be approximately fourteen feet in diameter. Tub 30 includes a non-rotatable floor 32 and a rotatable annular sidewall 35, vertically upstanding relative to the floor and cooperating with the floor to define a top opening container for receiving and holding material to be ground or pulverized. While wood and refuse are the probable materials to be ground, the unit may also be used to pulverize other materials. The floor rests upon an underlying framework 33, shown to advantage in FIG. 4, which preferably includes a pair of laterally spaced and parallel beams 31 and a pair of transversely spaced and parallel beams 34 which reinforce the floor and are caused to move therewith, as will hereinafter be explained. The floor of the tub hingably engages framework 25 of the chassis adjacent one side of the chassis by means of one or more hinges 23, shown in FIG. 5.

Figure 7:
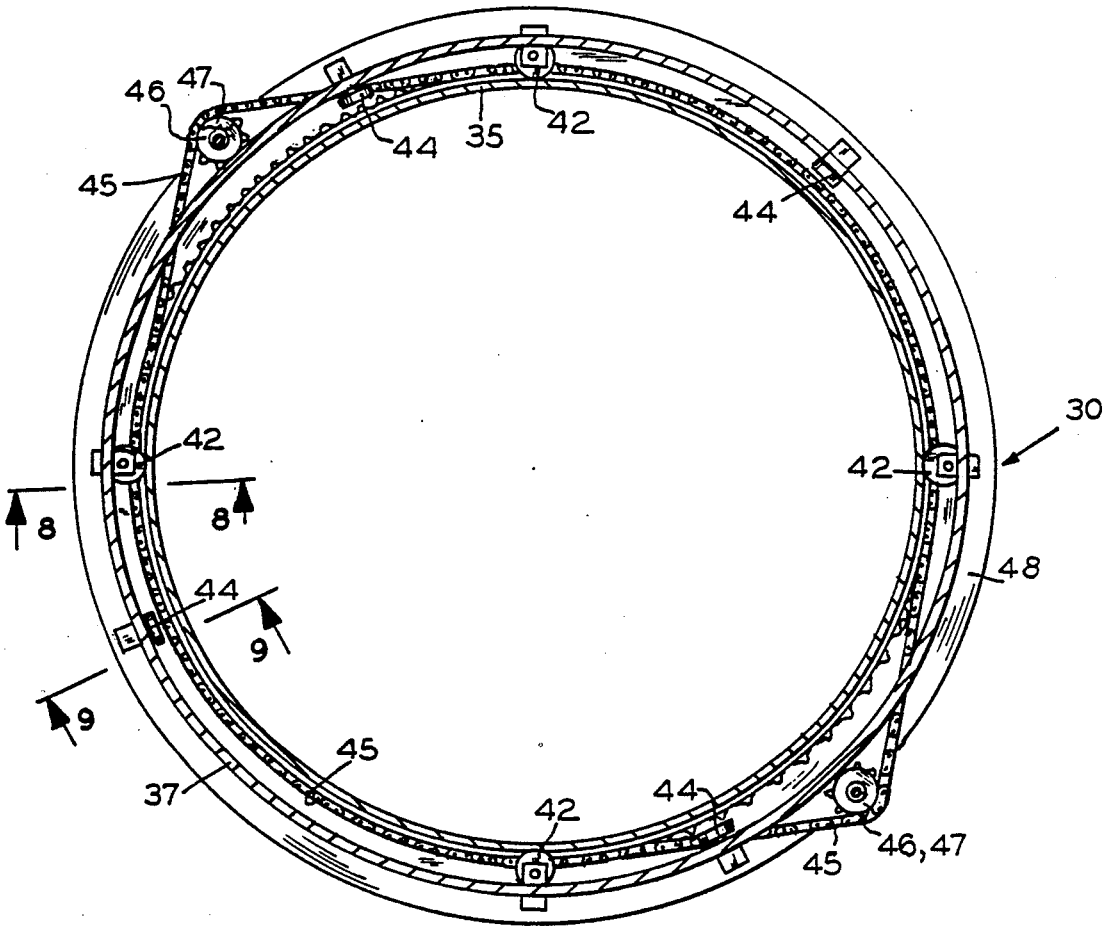
FIG. 7 is a sectional view taken along lines 7—7 of FIG. 8.
Figure 9:
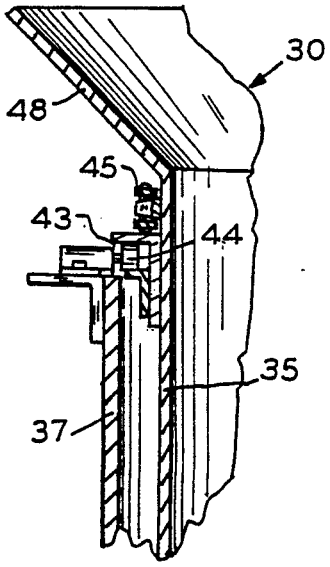
FIG. 9 is a sectional view taken along lines 9—9 of FIG. 7.
Figure 8:
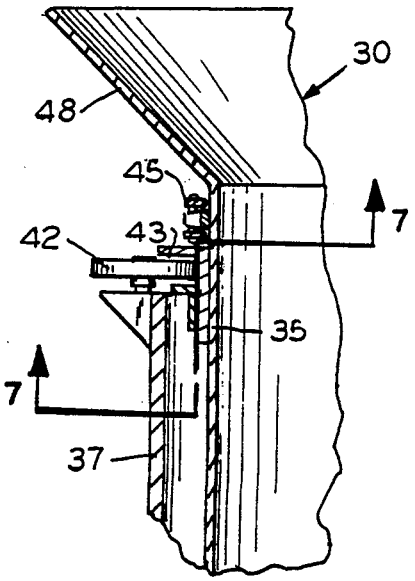
FIG. 8 is a sectional view taken along lines 8—8 of FIG. 7.

Upwardly extending from the floor is a circular housing 37, serving as a support for the rollers which, in turn, provide lateral and vertical support for the internally mounted sidewall 35 of tub 30. As seen to advantage in FIGS. 7 and 8, a plurality of horizontal rollers 42, each rotatably mounted on a vertically extending axle secured to housing 37, prevent lateral movement of the sidewall and a plurality of vertically oriented rollers 44, shown in FIGS. 7 and 9, each rotatably mounted about a horizontal axle secured to the housing, are caused to engage a pair of vertically spaced annular flanges 43 affixed to or a part of sidewall 35 and forming a track for rollers 44, to provide vertical support for the sidewall. An endless roller chain 45, affixed to the upper outer surface of tub sidewall 35 just above flanges 43, engages drive sprockets 46 for rotation of the sidewall. The drive sprockets are properly geared to reversible motors 47, affixed to housing 37, which provide the power for rotation of the sidewall. Motors 47, in turn, receive their power from prime mover 49, which provides all power for the unit. Sidewall 35 is provided on its interior wall, shown in FIG. 3, with a plurality of reinforced baffles extending substantially radially interior for movement of material within the tub into contact with the hammermill. The sidewall may also be provided with a funnel-shaped annulus 48, adjacent its top, to protect underlying equipment from material being placed into the tub and for increasing the capacity of the tub.

Figures 3, 4, 5, 6:
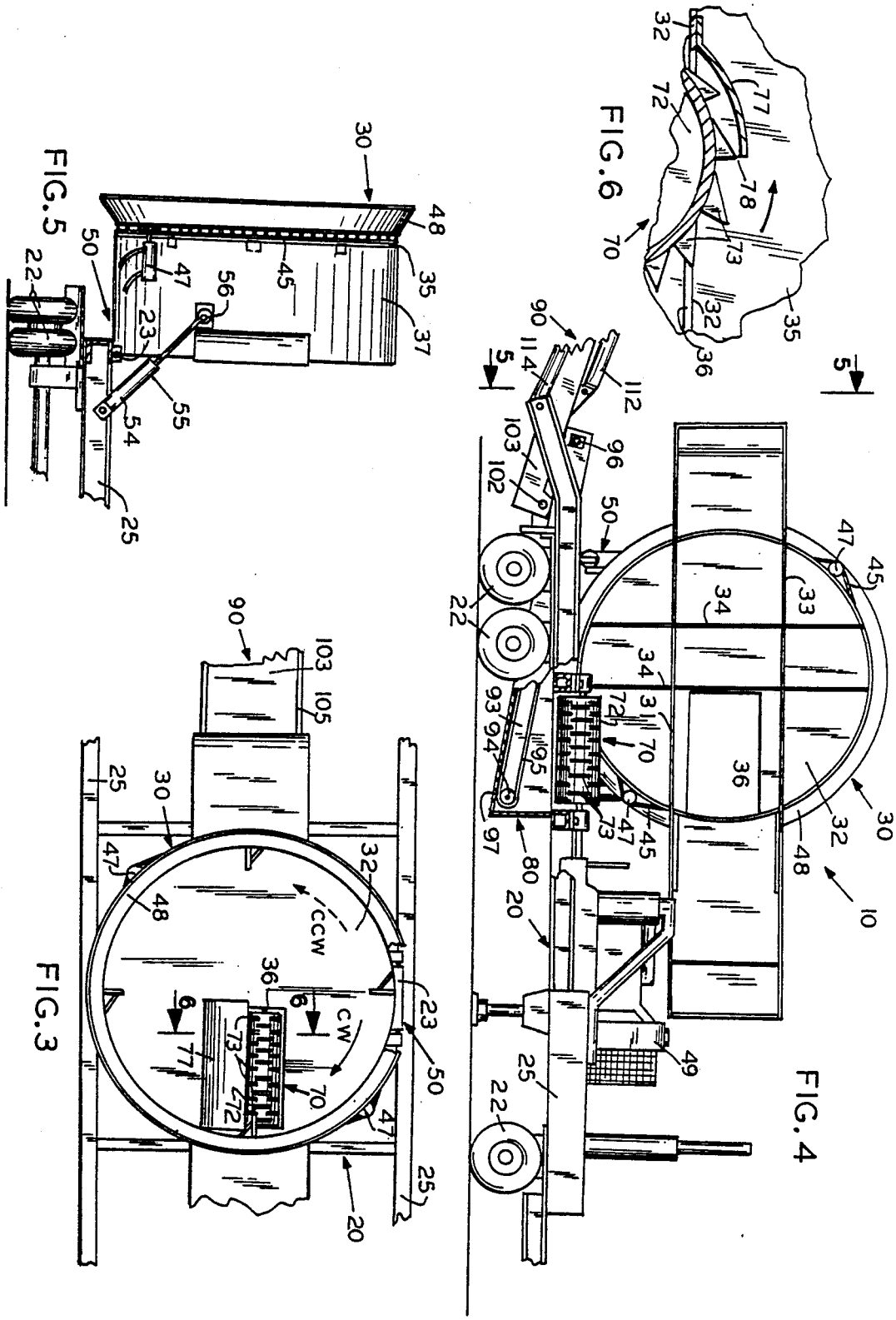
FIG. 3 is a plan view of the tub of the present invention with a solid arrow showing the normal clockwise direction of rotation of the tub sidewall and an arrow in broken lines showing counter clockwise rotation.
FIG. 4 is a side view, in partial section, of the apparatus of FIG. 1, showing the tub in a pivoted position for emptying and for providing access for maintenance.
FIG. 5 is a view taken along lines 5—5 of FIG. 4.
FIG. 6 is a fragmental section taken along lines 6—6 of FIG. 3.

Referring now to FIG. 5, it will be seen that mounted between frame 25 of chassis 20 and housing 37 is pivoting means 50, preferably including one or more piston-cylinder units 55. Hydraulic cylinder 54, of each unit, may be pivotally secured at one end to frame 25 of the chassis and the piston pivotally secured at 56 on the housing holding the tub. Activation of piston-cylinder units 55 cause the tub, including floor and sidewall, to pivot about hinge 23 from an upright position to a tilted, substantially horizontal position transverse to the normal direction of travel of the chassis, and back to its original position. The tub, which normally turns clockwise, when viewed from above, may be rotated in either direction, as shown in FIG. 3. Reversing the direction, when the units is in a grinding mode, aids in cleaning the unit, should it become plugged with debris and, when in the pivoted position, to aid in emptying materials which cannot be ground or pulverized.

Material grinding means 70 includes a rotatable rotor drum 72, to which is secured a multiplicity of material impact members 73. The impact members may be in the nature of knives for chopping wood; hammers for pulverizing refuse; or may have other characteristics depending upon the material to be worked. Drum 72 is driven by prime mover 49 through an appropriate coupling and is placed with its axis of rotation being parallel with the normal direction of movement of the chassis. Impact members are of sufficient length and/or drum 72 is set at a height so that the impact members, which extend through aperture 36 cut in or defined by floor 32 of tub 30, are above the plane of the top surface of the floor approximately twelve inches for impacting material within the tub, when the tub is in its operational, vertical, position.

As may be seen to advantage in FIGS. 3 and 6, mounted to the top surface of floor 32 by welding, bolts, or otherwise, is a deflection shield 77. Shield 77 is mounted adjacent aperture 36 and extends at least a short distance over drum 72, leaving a small gap of an inch or two between the shield and impact members 73 to direct ground materials into the underlying bin to prevent recirculation of material already ground and to prevent material impacted by the hammermill from flying out of the tub. In its extension over the drum, the shield, in cooperation with the floor and drum, defines an opening 78 for the reception of ground material. The opening thus defined is in a direction opposite the rotational direction of the tub sidewall, shown by the arrow in FIG. 3, so that material moved by the rotating sidewall will be directed toward opening 78 and hence into contact with impact members 73 of the drum.

Affixed to frame 25 of chassis 20, directly below grinding means 70 is bin 80 for receiving ground, chopped, or pulverized material. Bin 80 may be provided with a grate, not shown, for regulating size of material entering the bin.

For removing material from the bin, conveyor means 90 is provided. As shown in FIGS. 1, 2, and 4, conveyor means 90 preferably includes a pair of endless belt type conveyors, first conveyor 93 and second conveyor 103. First conveyor 93 includes a drive roller 94 at one end and an idler roller 96 at the other end for rotation of endless belt 95 to remove ground material from bin 80 and to transport it to second conveyor 103. An underlying platform provides support for the top flight of the belt and the ground material thereon.

Second conveyor 103 includes two frame sections 104 and 105 engaging one another by hinge pins 101. Each of the frame sections is provided with its own platform for supporting the top flight of a single endless belt 107 mounted upon a drive roller 109 located at one end of the conveyor and and idler roller 108 located at the opposing end of the conveyor. Hinge pins 101 are located slightly below the longitudinal center of conveyor 103 for proper folding of frame section 104 over tub 30, as shown in FIG. 2. Frame section 105 includes one or more pivot pins 102 in its engagement with frame 25 of chassis 20 for pivoting to a substantially vertical position as shown in FIG. 2. Hydraulic piston-cylinder units 114 pivot conveyor 103 to and from a vertical position about pins 102 and piston-cylinder units 112 pivot conveyor frame sections 104 and 105 of conveyor 103 relative to one another for folding the sections, as shown in FIG. 2. Endless belt 107 is sufficiently elastic to permit the folding of the conveyor. In its operational mode, conveyor 103 underlies the end of conveyor 93 to receive the ground material. Each of the conveyors include sidewalls to hold the material on the belt.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Grinding apparatus comprising:

a mobile chassis;

a top opening tub for receiving materials to be ground, said tub provided with a rotatable sidewall and a non-rotatable floor and said tub pivotally mounted to said chassis for pivoting from a vertical position to a horizontal tilted position laterally transverse to the normal direction of travel of said chassis;

rotation means for rotating the sidewall of said tub;

pivot means for selected tilting of said tub, said pivot means having a rotational axis parallel with the direction of travel of said chassis;

material grinding means mounted to said chassis and extending upwardly through an opening in the floor of said tub for grinding material within the confines of said tub, when said tub is in the vertical position;

a bin mounted to said chassis below said grinding means for receiving ground material; and conveyor means affixed to said chassis and rearwardly extending for conveying ground material from said bin.

2. The apparatus as described in claim 1 wherein said conveyor means includes a power driven endless belt.

3. The apparatus as described in claim 2 wherein said conveyor means is foldable over said tub into a storage mode for transporting said apparatus.

4. The apparatus as described in claim 1 further comprising a deflection shield mounted on the top surface of said tub floor adjacent said floor opening to prevent material contacting said grinding means from being thrown from said tub.

5. The apparatus as described in claim 4 wherein said shield extends at least partially over said grinding means and wherein said shield defines a material intake opening which opens in a direction for receiving material from said rotating sidewall of said tub.

6. The apparatus as described in claim 1 wherein said tub includes a housing surrounding said sidewall and wherein said rotation means includes an endless roller chain affixed to said sidewall and at least one motor affixed to said housing, and pivotal therewith, for engaging said roller chain for rotating said sidewall of said tub.

7. The apparatus as described in claim 6 wherein said motor is reversible for reverse rotation of said tub sidewall.

8. Grinding apparatus comprising:

a mobile chassis;

a top opening tub for receiving materials to be ground, said tub provided with a rotatable sidewall and a non-rotatable floor and said tub pivotally mounted to said chassis for pivoting from a vertical position to a horizontal tilted position laterally transverse to the normal direction of travel of said chassis;

rotation means for rotating the sidewall of said tub;

pivot means coupling said floor to said chassis for selective tilting of said tub, said pivot means having a rotational axis parallel with the direction of travel of said chassis;

material grinding means mounted to said chassis and extending upwardly through an opening in the floor of said tub for grinding material within the confines of said tub when said tub is in the vertical position;

a bin mounted to said chassis below said grinding means for receiving ground material;

a first conveyor affixed to said chassis and extending rearward of said chassis, parallel to the normal direction of travel of said chassis, for conveying ground material from said bin; and a second conveyor affixed to said chassis and extending rearward of said first conveyor; said second conveyor operable to receive material from said first conveyor and said second conveyor provided with two framework sections hingably engaging one another for the folding of said second conveyor over said tub for transporting said apparatus.

9. The apparatus as described in claim 8, wherein said second conveyor includes an idler roller adjacent one end thereof; a drive roller adjacent the opposing end thereof, and a single endless belt mounted on said rollers and wherein each of said framework sections includes a separate platform for supporting the top flight of said endless belt.

10. The apparatus as described in claim 8 further comprising a deflection shield mounted on the top surface of said tub floor adjacent said floor opening to prevent material contacting said grinding means from being thrown from said tub.

11. The apparatus as described in claim 10 wherein said shield extends at least partially over said grinding means and wherein said shield defines a material intake opening which opens in a direction for receiving material from said rotating sidewall of said tub.

12. The apparatus as described in claim 8 wherein said tub includes a housing surrounding said sidewall and wherein said rotation means includes an endless roller chain affixed to said sidewall and at least one motor affixed to said housing, and pivotal therewith, for engaging said roller chain for rotating said sidewall of said tub.

13. The apparatus as described in claim 12 wherein said motor is reversible for reverse rotation of said tub sidewall.

* * * * *